US008861775B2

(12) United States Patent
McPherson

(10) Patent No.: US 8,861,775 B2
(45) Date of Patent: Oct. 14, 2014

(54) STEREO SYSTEM AND SPEAKERS FOR A WATERCRAFT

(75) Inventor: Steven McPherson, Encintas, CA (US)

(73) Assignee: Waveaudia, Vista, CA (US)

( * ) Notice: Subject to any disclaimer, the term of this patent is extended or adjusted under 35 U.S.C. 154(b) by 1312 days.

(21) Appl. No.: 12/556,551

(22) Filed: Sep. 9, 2009

(65) Prior Publication Data

US 2010/0092015 A1 Apr. 15, 2010

Related U.S. Application Data

(60) Provisional application No. 61/095,599, filed on Sep. 9, 2008.

(51) Int. Cl.
*H04R 1/02* (2006.01)
*B63B 35/73* (2006.01)

(52) U.S. Cl.
CPC ..... *H04R 1/026* (2013.01); *B63B 35/731* (2013.01); *H04R 1/025* (2013.01)
USPC ..... 381/389; 381/386; 381/302; 381/86; 381/87; 381/300; 381/304; 381/120

(58) Field of Classification Search
USPC ..... 381/120, 307, 384, 386, 389, 302, 86, 381/87, 300, 304
See application file for complete search history.

(56) References Cited

U.S. PATENT DOCUMENTS

| | | | | |
|---|---|---|---|---|
| 5,894,810 | A * | 4/1999 | Orr | 114/343 |
| 2003/0044039 | A1 * | 3/2003 | Sterns et al. | 381/386 |
| 2005/0151422 | A1 * | 7/2005 | Gilmour | 307/10.1 |

* cited by examiner

*Primary Examiner* — Paul Kim
(74) *Attorney, Agent, or Firm* — Mintz Levin Cohn Ferris Glovsky and Popeo, P.C.

(57) ABSTRACT

A speaker and stereo system for a watercraft are disclosed. The stereo system includes an amplifier sized and adapted to fit within an internal compartment of the watercraft, and having a power input that connects to a battery of the watercraft for power. The amplifier further includes a control input, a signal amplifier, at least two audio outputs connected to the signal amplifier, and an audio input for receiving a digital audio signal from a digital music player to be amplified by the signal amplifier. The speaker for use with the stereo system includes a speaker housing having a flattened bottom, an opening at a front face, and an enclosure that tapers and extends to a substantially pointed terminal end. The speaker further includes a waterproof loudspeaker pivotally connected within the opening of the front face of the speaker housing to face a direction substantially opposite the pointed terminal end, and a mounting mechanism for removably mounting the speaker housing to an outer surface of the watercraft.

15 Claims, 7 Drawing Sheets

(A)

(B)

(C)

STEREO SYSTEM AND SPEAKERS FOR A WATERCRAFT

CROSS REFERENCE TO RELATED APPLICATIONS

This application claims the benefit of priority under 35 U.S.C. §119 to U.S. Provisional Patent Application Ser. No. 61/095,599, filed on Sep. 9, 2008, entitled, "Stereo System And Speakers For A Watercraft", the entire disclosures of which is incorporated by reference herein.

BACKGROUND

Millions of small watercraft have been sold worldwide without a sound system or stereo. One reason is that viable waterproof stereos and speakers are relatively non-existent, or do not exist in a form suitable for the rough environmental conditions to which such watercraft are subjected. Further, most watercraft depend on not having too many holes in their outer shell or hull, the slightest of which could compromise the integrity of the watercraft.

SUMMARY

This document presents a waterproof stereo, including at least one pair of waterproof speakers that can be mounted to a watercraft without the need to drill holes in the hull or vessel shell of the watercraft.

A stereo system for a watercraft is presented. The stereo system includes an amplifier that connects to a battery of the watercraft for power, the amplifier including a control input, a signal amplifier, at least two audio outputs connected to the signal amplifier, and an audio input for receiving a digital audio signal from a digital music player to be amplified by the signal amplifier. The stereo system further includes a controller for mounting to the watercraft and connected by a control wire to the control input of the amplifier to control at least an output volume of the signal amplifier. One or more speakers for use with the stereo system each includes a speaker housing having a flattened bottom, an opening at a front face, and an enclosure that tapers and extends to a substantially pointed terminal end. Each speaker further includes a waterproof loudspeaker pivotally connected within the opening of the front face of the speaker housing to face a direction substantially opposite the pointed terminal end, and a mounting mechanism for removably mounting the speaker housing to an outer surface of the watercraft.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

Figure 1:
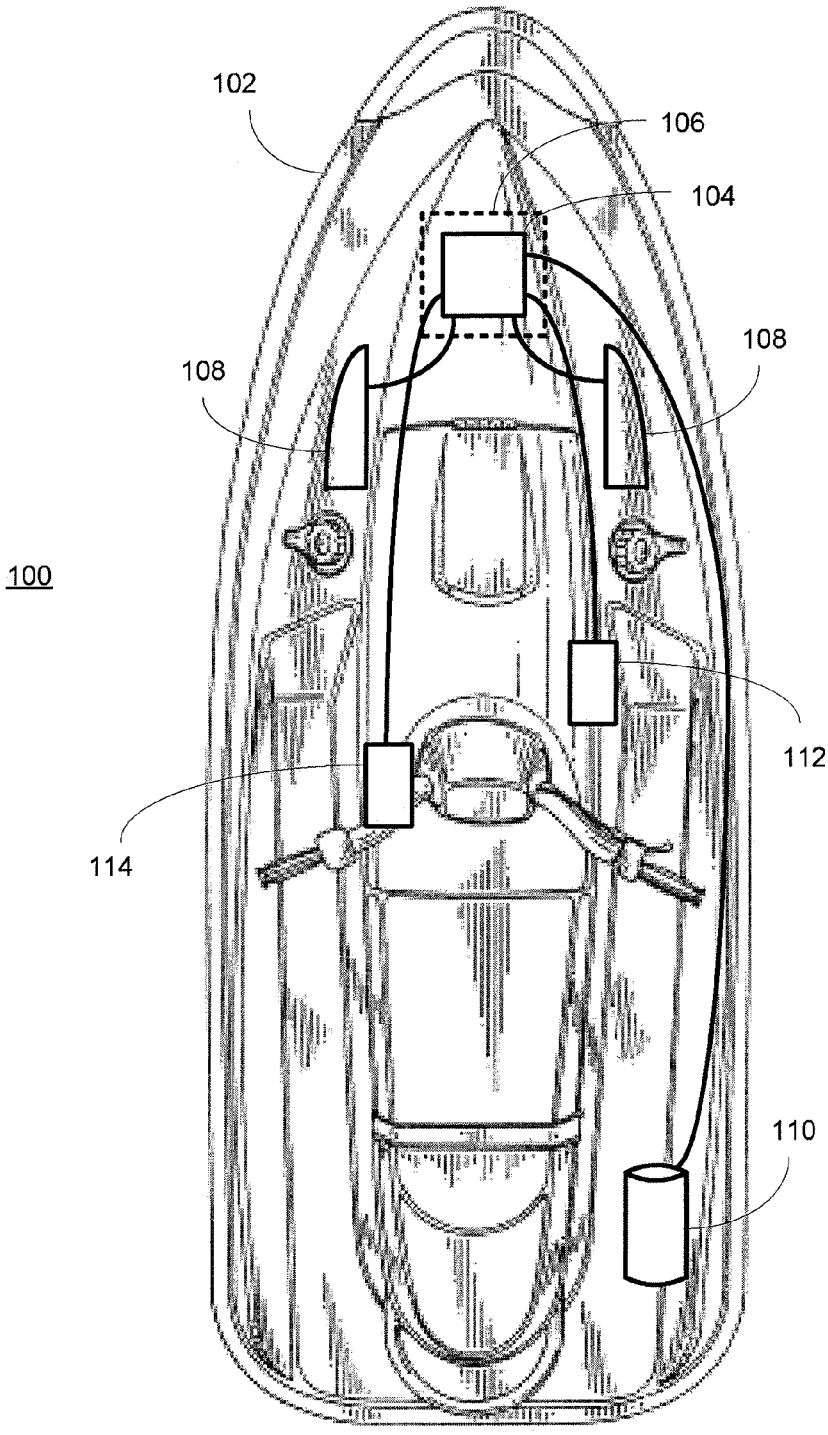
FIG. 1 is illustrates a watercraft stereo system.

FIG. 1 illustrates a watercraft stereo system 100 for use with a watercraft 102 such as a personal watercraft like a jet ski, a "ski-doo," small motorboat, sailboat or other type of watercraft. The stereo system 100 includes an amplifier 104 mounted in a compartment 106 of the watercraft 102. The compartment 106 is sealed from the environment of the watercraft 102 by a waterproof or leak-proof sealed door or opening. The amplifier 104 includes a signal amplifier that is preferably a low to moderate power digital amplifier with a low power draw, including a multi-step volume control. The amplifier 104 is also preferably implemented in digital circuitry enclosed in a solid potted enclosure for robustness, withstanding vibration and impacts, and for further resistance to environmental factors such as water, salt and air. The stereo system 100 is controlled to automatically shut off if it receives no signal for a predetermined period of time.

The amplifier 104 includes at least two or more outputs to watercraft speakers 108, which are mounted in elongated and curved enclosures and mounted to the outer surface of the watercraft 102 by mounts that do not require drilling through the outer surface or into the hull or compartment of the watercraft 102. The details, arrangement, and preferred implementation of the speakers 108 will be described in further detail below.

The stereo system 100 is preferably connected to the watercraft's on-board battery system 110. Alternatively, the stereo system 100 can include a battery or other power source connected to and dedicated to the amplifier 104. The amplifier 104 can include one or more digital inputs, including a connection to a digital music device 112 and a separate volume controller 114. The volume controller 114 can be mounted near the handlebars or throttle of the watercraft 102, and may also include control functions of, in addition to volume control, forward and reverse, skip forward, skip back, pause, play, or other controls. The volume controller 114 is preferably a flattened, touch-sensitive membrane controller, that can also be mounted by way of two-sided tape.

Figure 2:
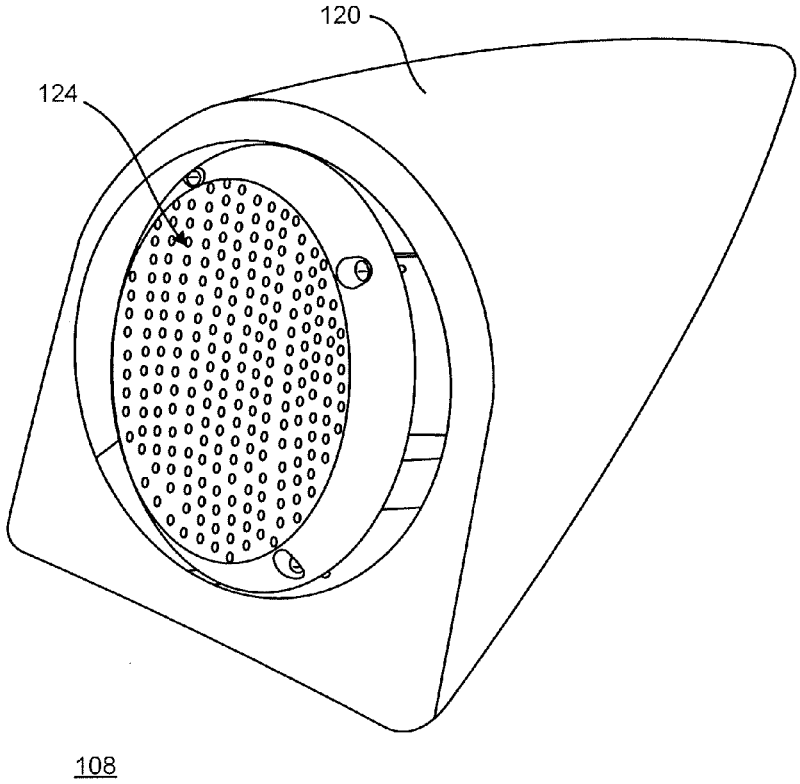
FIG. 2 is a perspective view of a speaker.

FIG. 2 is a perspective view of a speaker 108. The speaker 108 includes a housing 120 that defines an enclosure is elongated and that tapers from an opening for a loudspeaker 124 to a point on an opposite side, and having a flattened or slightly curved bottom or underside to accommodate the planar or curved arrangement of an outer surface of the watercraft. The loudspeaker 124 is preferably an all-weather, water-resistant speaker that can be rigidly mounted in the housing. Alternatively, the loudspeaker 124 can be mounted to swivel or pivot about one or more axes, or in two or more directions, so that a user can adjust the angle of the loudspeaker 124 relative to the housing for optimal sound direction. Each speaker 108 includes a waterproof female monojack for connecting to the main amplifier and sound processor. Alternatively, each speaker 108 can include a wireless transceiver or receiver for receiving short-range wireless signals from the amplifier and sound processor for wireless projection of sound. In this alternative implementation, the speaker 108 includes one or more batteries encased therein, or some other independent power source.

Figure 3:
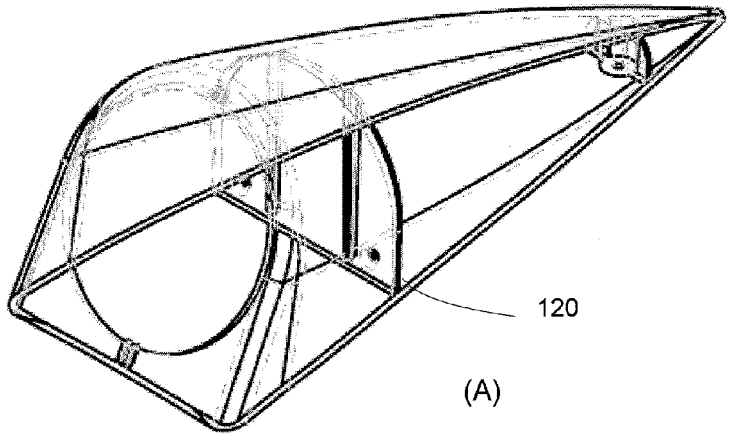
FIGS. 3A-C show various views of a speaker housing.
Figure 3:
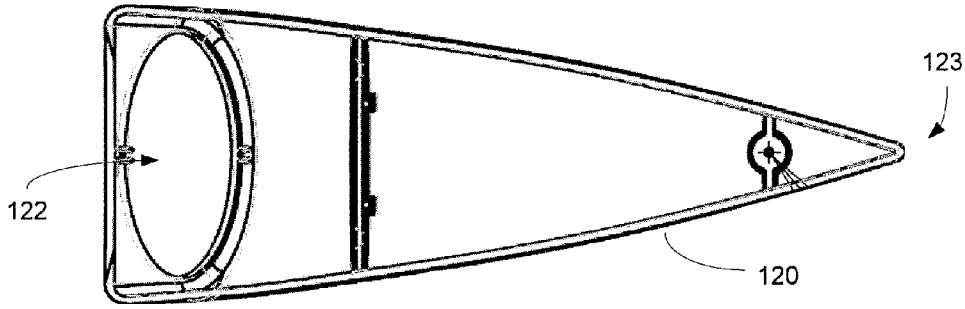
Figure 3:
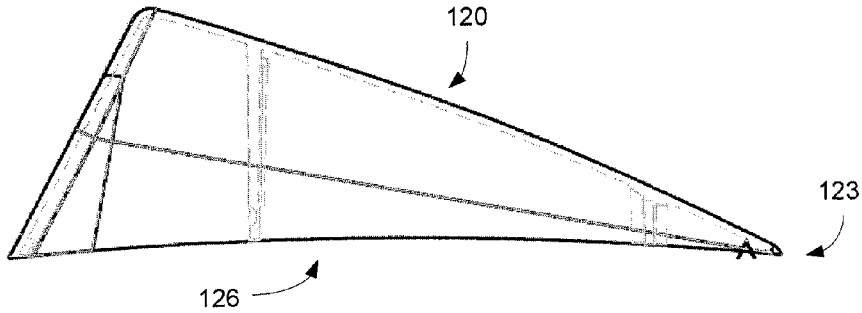

FIGS. 3A-C show alternative views of a speaker housing 120 according to alternative implementations. The speaker housing 120 includes an opening 122 at a front face, and tapers and extends to a terminal end 123. The opening 122 is sized and adapted to receive a loudspeaker 124. The housing 120 is preferably rounded, except for a planar or slightly curved underside 126, which is shaped and adapted for fitting against and outer surface of a watercraft. The tapered shape of the speaker housing 120 lessens wind resistance, and inhibits the speaker from catching or snagging on external objects, while also causing movement of the watercraft to force wind onto the housing to keep it abutted against the watercraft. Any internal area of the speaker housing 120 that is not taken up by the loudspeaker 124, any mounting hardware or electronics, can be filled with foam or other filler material that allows the speaker housing 120 to remain afloat in the event of disengaging from the watercraft, or being inadvertently or otherwise dropped into water. The filler material can also be configured to improve or optimize the sound quality emanating from the loudspeaker.

Figure 4:
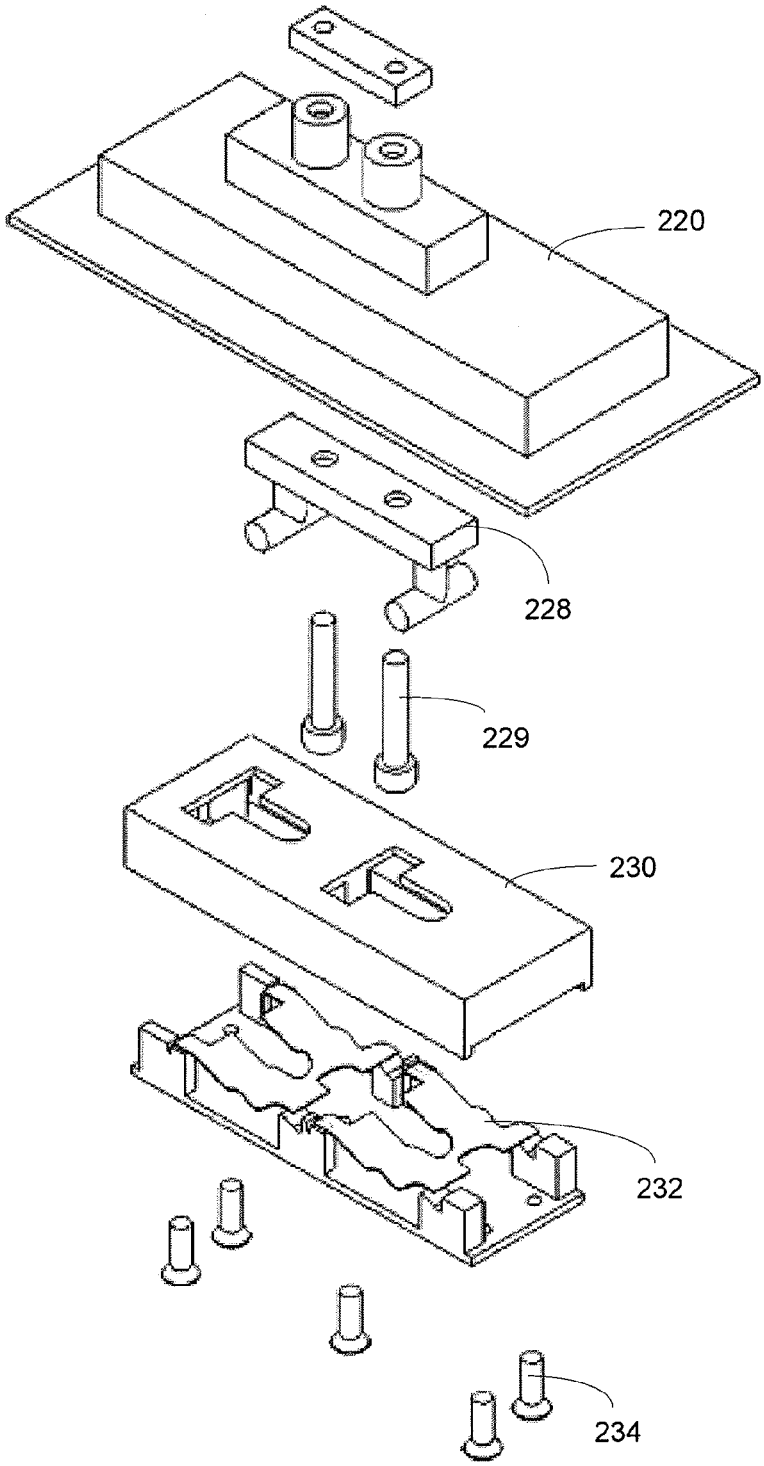
FIG. 4 shows one implementation of a mounting system for a speaker.

FIG. 4 shows one implementation of a mounting system for a speaker 208, for mounting the speaker 208 to an outer surface of a watercraft without needing to drill holes through the watercraft. The housing 220 includes a bolt receptacle mechanism formed therein, to receive bolts or screws 229 that attach a dual T-bar mechanism 228 to the underside of the housing 220. Each T-bar of the T-bar mechanism 228 slides into a corresponding T-shaped slot in a base cover 230 to engage and lock the speaker to the mounting system. The T-bars enter into the slot, and a biasing mechanism in a mounting base 232 engage the T-bars from being easily released. Screws or bolts 234 connect and maintain the mounting base 232 to the base cover 230.

Figure 5:
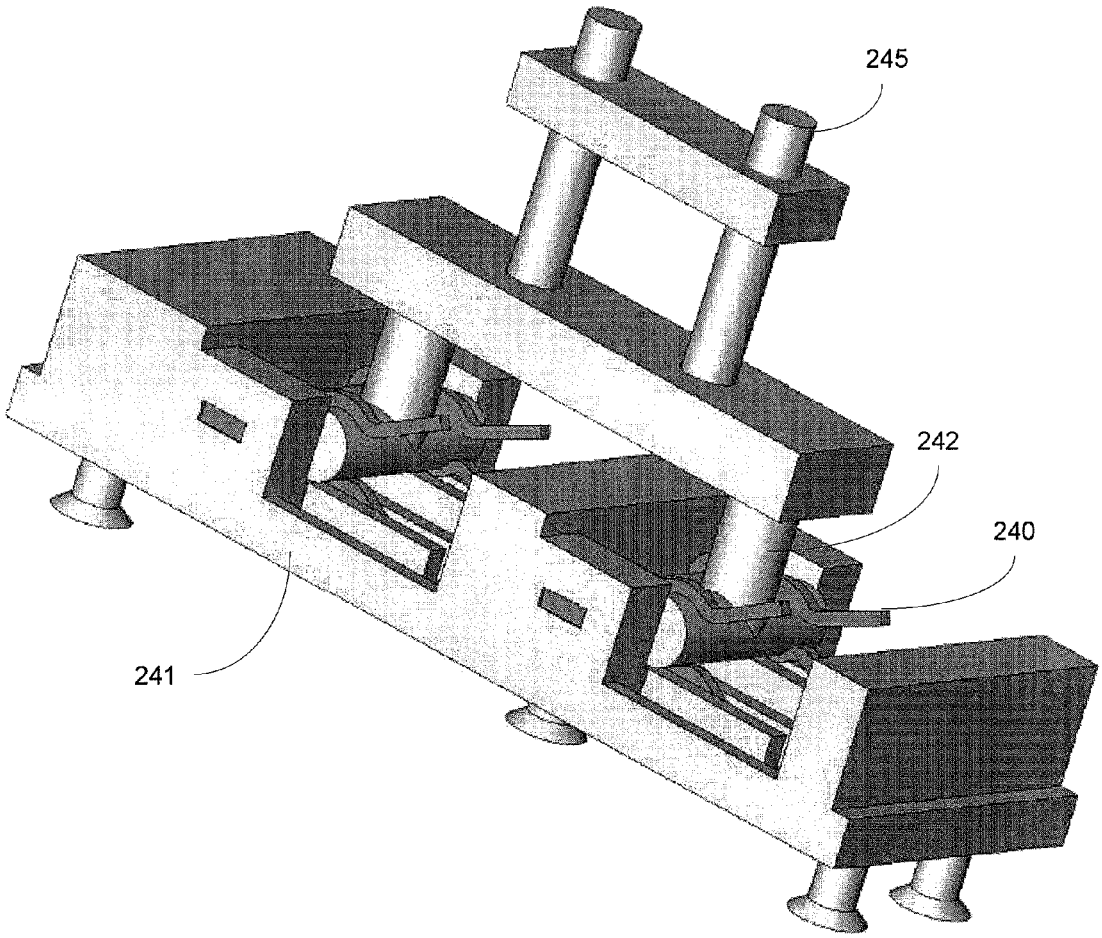
FIG. 5 shows another implementation of a mounting system for a speaker.

FIG. 5 shows an alternative implementation of a mounting system, in which the biasing mechanism includes multiple clips 240 connected with mounting base 241 to hold T-bars 242 of speaker mount 245 in place. The mounting base 232 of any mounting system can be glued or taped onto the watercraft at a desired location, and the speakers can be removably mounted thereon when in use, and removed when the watercraft is being transported or when the stereo system is not being used.

Figure 6:
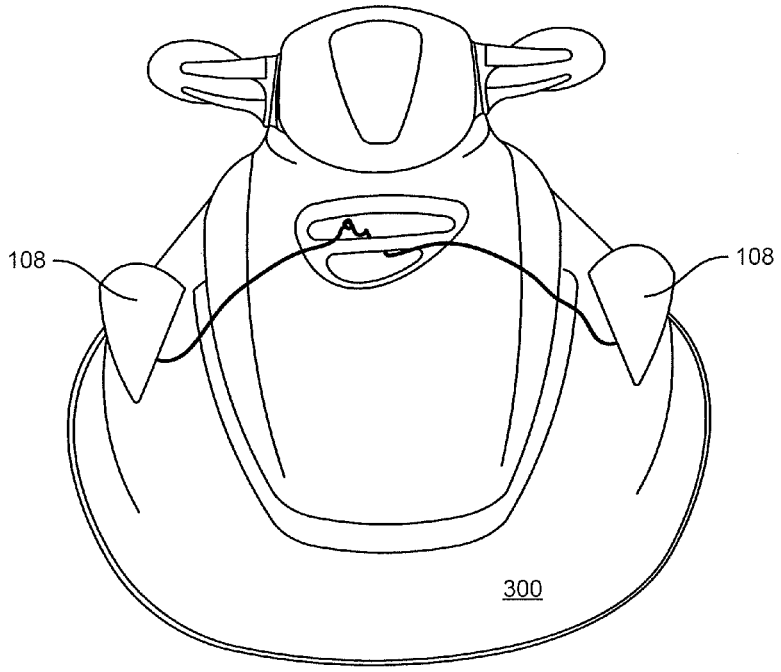
FIG. 6 shows two speakers mounted to an outer surface of a watercraft.

FIG. 6 shows a pair of speakers 108 connected to an outer surface of a personal watercraft 300, forward of the seat and below the steering mechanism of the personal watercraft 300. Power and signal wires for the speakers 108 can be flattened wires, and threaded into an outer compartment of the personal watercraft 300.

Figure 7A:
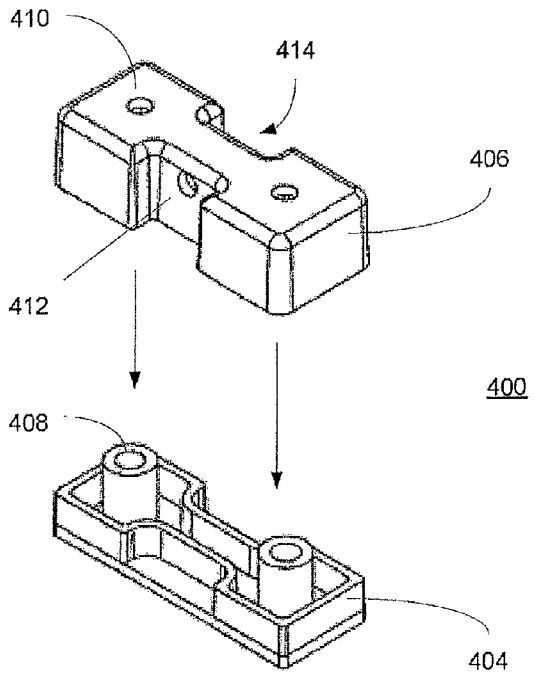
FIGS. 7A and 7B show yet another implementation of a mounting system for the speakers.
Figure 7B:
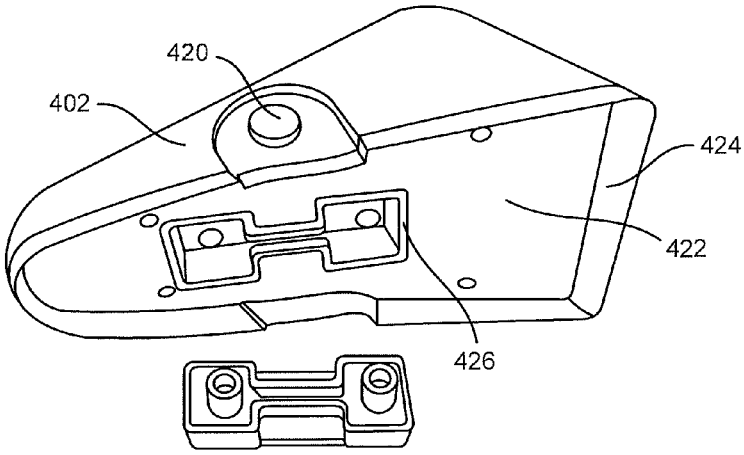

FIGS. 7A-B show and illustrate a mounting block 400 for mounting a speaker 402 to an outer surface of a watercraft. The mounting block 400 includes an anchor bracket 404 and a cap 406 that fits over and connects to the anchor bracket 404. The anchor bracket 404 includes a flat or slightly curved underside that mounts to the outer surface of the watercraft and is held in place by two-sided tape, glue, or other connective material. The anchor bracket 404 also includes one or more receptacles 408 for receiving a screw, bolt or other connector that is threaded through thru-holes 410 in the top of the cap 406.

In some implementations, the anchor bracket 404 and cap 406 are shaped symmetrically, so as to be able to be mounted without regard to direction. The cap 406 includes a narrow bridge section 404 having opposing apertures 412 in the sides thereof. The apertures 412 each receive and engage one of pin (not shown), each connected to a pair of spring plungers 420 through the shell of the speaker 402. In operation, the anchor bracket 404 is mounted to the outer surface of the watercraft. The cap 406 is placed over the anchor bracket 404, and adjustably tightened down to a desired level and/or angle by screws through thru-holes 410 and into receptacle 408. Then, the speaker 402, which has a cavity 426 that is shaped to fit closely over the cap 406, is placed over the cap 406 and connected in place by pins connected to spring plungers 420. Accordingly, the speaker 402 is easily mounted on, and removed from, the mounting block 400.

In yet other variations, the mounting block 400 can be made of a unitary piece of material, rather than in two sections that are connected together. The pins that engage the apertures can be tapered so as to allow a simple clip-on action of the speaker 402 to the mounting block 400 without needing to operate spring plungers 420 until removal of the speaker 420 from the mounting block 400 is desired.

The speaker 402 has a flattened or slightly curved bottom surface 422 that is water-tight or near water-tight. The speaker 402 may also include a flexible flap 424 extending from the peripheral edge of the bottom surface 422 to further achieve a better fit and inhibit water from entering into the bottom of the speaker 402. The flexible flap 424 can be rubber or silicone, and can be adapted to withstand large swings in temperature, humidity or other environmental factors.

Although a few embodiments have been described in detail above, other modifications are possible. For example, the speakers can be battery-powered or otherwise self-powered, and can receive the audio signals wirelessly from the amplifier or a wireless audio transmitter. Other embodiments may be within the scope of the following claims.

The invention claimed is:

1. A stereo system for a watercraft, the stereo system comprising:

an amplifier that connects to a battery of the watercraft for power, the amplifier including a control input, a signal amplifier, at least two audio outputs connected to the signal amplifier, and an audio input for receiving a digital audio signal from a digital music player to be amplified by the signal amplifier;

a controller for mounting to the watercraft and connected by a control wire to the control input of the amplifier to control at least an output volume of the signal amplifier;

a pair of speakers, each speaker adapted to be connected by a speaker wire to one of the at least two audio outputs, each speaker comprising:

a speaker housing having a flattened bottom, an opening at a front face, and an enclosure that tapers and extends to a substantially pointed terminal end;

a waterproof loudspeaker pivotally connected within the opening of the front face of the speaker housing to face a direction substantially opposite the pointed terminal end; and a mounting mechanism for removably mounting the speaker housing to an outer surface of the watercraft, the mounting mechanism comprising a mounting base that is sealed with the outer surface of the watercraft, the mounting base having one or more slots and a clip over each slot, the mounting mechanism further comprising one or more T-bars connected with the speaker housing and adapted to be inserted into a corresponding slot to engage the clip and mount the speaker housing to the outer surface of the watercraft.

2. A stereo system in accordance with claim 1, wherein the speaker wire is a flattened speaker wire.

3. A stereo system in accordance with claim 1, further comprising a waterproof receptacle connected to the audio input of the amplifier and adapted to receive and mount the digital music player to the watercraft.

4. A stereo system in accordance with claim 1, wherein the controller is a flat membrane switch.

5. A stereo system in accordance with claim 1, wherein the amplifier is sized and adapted to fit into an inner compartment of the watercraft.

6. A stereo system in accordance with claim 1, wherein the signal amplifier includes solid potted electronics.

7. A stereo system in accordance with claim 1, wherein the enclosure of each speaker is at least partially filled with a filler material that floats when placed in water.

8. A stereo system in accordance with claim 7, wherein the filler material includes foam.

9. A stereo system in accordance with claim 1, wherein the enclosure of each speaker is at least partially filled with a filler material that floats when placed in water.

10. A stereo system in accordance with claim 9, wherein the filler material includes foam.

11. A stereo system for a watercraft that has an onboard battery and at least one internal compartment, the stereo system comprising:

an amplifier sized and adapted to fit within the at least one internal compartment, and having a power input that connects to the battery for power, the amplifier further including a control input, a signal amplifier, at least two audio outputs connected to the signal amplifier, and an audio input for receiving a digital audio signal from a digital music player to be amplified by the signal amplifier;

a controller for mounting to the watercraft and connected by a control wire to the control input to control at least a volume of the at least two audio outputs of the amplifier;

at least two speakers, each speaker adapted to be connected by a speaker wire to one of the at least two audio outputs, each speaker comprising:

a speaker housing having a flattened bottom, an opening at a front face, and an enclosure that tapers and extends to a substantially pointed terminal end;

a waterproof loudspeaker pivotally connected within the opening of the front face of the speaker housing to face a direction substantially opposite the pointed terminal end; and a mounting mechanism for removably mounting the speaker housing to an outer surface of the watercraft, the mounting mechanism comprising a mounting base that is sealed with the outer surface of the watercraft, the mounting base having one or more slots and a clip over each slot, the mounting mechanism further comprising one or more T-bars connected with the speaker housing and adapted to be inserted into a corresponding slot to engage the clip and mount the speaker housing to the outer surface of the watercraft.

12. A stereo system in accordance with claim 11, wherein the speaker wire is a flattened speaker wire.

13. A stereo system in accordance with claim 11, further comprising a waterproof receptacle connected to the audio input of the amplifier and adapted to receive and mount the digital music player to the watercraft.

14. A stereo system in accordance with claim 11, wherein the controller is a flat membrane switch.

15. A stereo system in accordance with claim 11, wherein the signal amplifier includes solid potted electronics.

* * * * *